US006421594B1

(12) United States Patent
Erasmus

(10) Patent No.: US 6,421,594 B1
(45) Date of Patent: Jul. 16, 2002

(54) METHOD FOR HEATING THE PAVING SCREED OF A ROAD FINISHER AND ELECTRICAL HEATING MEANS

(75) Inventor: Stephan Erasmus, Mannheim (DE)

(73) Assignee: Joseph Vogele AG, Mannheim (DE)

( * ) Notice: Subject to any disclaimer, the term of this patent is extended or adjusted under 35 U.S.C. 154(b) by 0 days.

(21) Appl. No.: 09/527,114

(22) Filed: Mar. 16, 2000

(30) Foreign Application Priority Data

Mar. 18, 1999 (DE) ..... 199 12 248

(51) Int. Cl.[7] ..... G06F 7/70; G06G 7/76

(52) U.S. Cl. ..... 701/50; 219/528; 392/472; 392/478; 404/71; 404/72; 404/95

(58) Field of Search ..... 701/50; 404/71, 404/95, 118, 107, 72, 75; 392/472, 478, 479, 480, 471; 38/77.83, 77.1, 77.5, 77.8, 77.7, 1 C, 1 D; 219/213, 548, 506, 549, 481, 497, 528, 635, 618, 676, 426

(56) References Cited

U.S. PATENT DOCUMENTS 4,347,016 A * 8/1982 Sindelar et al. ..... 404/95
5,042,179 A * 8/1991 van der Meer ..... 38/77.83
5,417,516 A * 5/1995 Birtchet ..... 404/71
5,472,292 A * 12/1995 Wiley ..... 404/79
5,763,858 A * 6/1998 Jones ..... 219/506
5,791,814 A * 8/1998 Wiley ..... 404/91
5,832,178 A * 11/1998 Schave ..... 392/472
5,974,227 A * 10/1999 Schave ..... 392/478
6,127,653 A * 10/2000 Samuels ..... 219/213
RE36,981 E * 12/2000 Birtchet ..... 404/71
6,172,647 B1 * 1/2001 Jones ..... 219/213
6,227,762 B1 * 5/2001 Van Velsor ..... 404/95

FOREIGN PATENT DOCUMENTS

JP 08291505 A * 11/1996

* cited by examiner

*Primary Examiner*—Jacques H. Louis-Jacques
(74) *Attorney, Agent, or Firm*—Nilles & Nilles, S.C.

(57) ABSTRACT

According to the method for heating the paving screed of a road finisher, said paving screed including a heating means with several heat elements being supplied with electric power from a rotary current generator and being switched on and off by means of a control device, at least two of said heating elements are switched on and switched off periodically and alternatingly in dependence from the operation temperature of said generator and/or the operation temperature of paving screed components contacting paving material. Said heating means comprises in its control device a microprocessor management section with a program for alternatingly switching between heating elements in cycles under consideration of a predetermined combination of operational parameters.

21 Claims, 3 Drawing Sheets

METHOD FOR HEATING THE PAVING SCREED OF A ROAD FINISHER AND ELECTRICAL HEATING MEANS

BACKGROUND OF THE INVENTION

The present invention relates to a method for heating the paving screed of a road finisher having a heating means within the paving screed including several electric heating elements supplied by a rotary current generator with current and to an electric heating means of a paving screed of a road finisher having a plurality of heating elements associated within the paving screed to working components. The heating elements are connected by a control device each alone or several in groups to a rotary current generator.

It is known from practice to heat operation components of the paving screed of road finishers either electrically or by gas. The heating particularly is carried out at the so-called tamper-bar, the smoothing sole plates and at occasionally provided pressing bars. Said operation components have to be heated so that the heat paving material processed by them does not stick thereon. The temperature of the paving material as processed by the paving screed amounts to e.g. 170° C. Heating must be continued during paving. For example, in an electric heating means of a paving screed electric heating rods are distributed in said paving screed and are supplied by rotating current of a rotating current generator driven by the primary drive source, mostly a diesel engine. It is usual practice to operate the heating means of the paving screed permanently and under full power. However, this is loading the rotary current generator extremely, particularly in case of tough operating conditions and/or means a considerable waste of energy. It is an object of the invention to provide a method as men toned above and a paving screed heating means allowing to carry out said method, by which energy can be saved and long service times of the rotary current generator can be achieved.

OBJECTS AND SUMMARY OF THE INVENTION

Said object can be achieved by the features of claim 1 and the features of independent claim 9.

In case of the danger of an overload or overheating of the rotary current generator due to tough operation conditions, the load of the rotary current generator is reduced by switching on and off at least one heating element or switching over between at least two heating elements in a timed fashion or in cycles, respectively, so that the rotary current generator may cool down or does not reach its critical operation temperature, respectively. In this case the finding is considered that the already heated operation components of the paving screed have remarkable heat storing properties and a long heated after run time despite switching off of their heating elements during which after run time no significant temperature reduction occurs, and that additionally during the paving phase the heated paving material is contributing sufficient heat on its own so that said cycles of switching on/off or switching over do not result in a paving quality reduction or in undesired contaminations of the operation components. Alternatively or additively, the contributed heat of the processed paving material allows to save energy with the help of said cycles. Nevertheless, a sufficient heating of the screed is assured. Expediently, said cycles are carried out exclusively during the paving operation of the paving screed, in order to not delay heating-up the paving screed, and to use the heat contained in the paving material in a beneficial way when the road finisher is travelling with paving speed and when sufficient assisting heat is available.

The management-section of the heating means optionally monitor different operational parameters at the side of current generation and within the road finisher in order to adjust the consumed power towards a tolerable maximum. This is done by modulated switching on and switching off of heating elements. By said method heat contained in the paving material is used in an advantageous fashion, energy is saved, and the rotary current generator is prevented from excessive load, e.g. in case of tough operating conditions.

For the safety of the rotary current generator the timed control in cycles in any case can be carried out when the operation temperature of the rotary current generator has exceeded the ideal operation temperature by a predetermined temperature value, e.g. 20° C. Said condition normally is sufficiently far below the critical temperature threshold of the rotary current generator. By means of timed changeover switching steps the load of the rotary current generator can be reduced to an extent that the generator again cools down to its ideal operation temperature.

Expediently the heating elements of the left and the right paving screed half are alternatingly switched on and off. This means, of course, that even extension screed parts at the left and right base screed halves will be incorporated into said measure and, occasionally even mounted boardening parts which also need to be heated. For the time period of the timed switching cycles the rotary current generator needs to produce only about 50% of the maximum power.

Expediently the duration of the cycles amount to about 30 seconds. Those are time periods showing no significant influence on the paving quality or the tendency of the paving screed to become contaminated and which assure that no significantly tangible temperature variations occur in the paving screed.

To start with the timed switching cycles also e.g. the following monitored operational parameters are decisive: "is road finisher travelling, is paving material conveyed, and is rated speed of the primary drive source reached".

The operational temperature of the rotary current generator can reliably be detected by temperature sensitive resistors. A plurality of such temperature sensitive resistors is expedient in order to allow to survey different temperature threshold values.

A significant relief of the rotary current generator already can be achieved if the heating elements of one screed half are switched off while the heating elements of the other screed half are switched on. Said rotary current generator even could be relieved further if there are delay time periods adjusted between said switch over steps. Alternatively, it is possible to switch over with a timewise overlapping. The delay times or said timewise overlappings can be adjusted in proportion to the initial temperature of the generator.

Temperature sensitive resistors placed in the coiling of the rotary current generator reliably detect actual temperature values there.

In case that there is an additional heating system extending across the entire screed, said additional heating system expediently is excluded from the timed switching cycles.

Shockproof and/or CEE-outlets provided at the road finisher and/or at the paving screed allow to connect additional assistant systems, e.g. illumination systems for maintenance and/or night operation. Said outlets are controlled by said section via relays or contactors.

The actual current value is measured by means of a current converter. On the basis of said current value the power is calculated. The power information is transmitted to the section.

In order to actually only control in cycles when this is useful, the heating selecting switch can suppress the control operation in cycles in the "manual" position of the heating selector switch.

Expediently further outlets are provided at the paving screed serving to connect heating elements of broadening parts of the paving screed. Said heating elements of the broadening parts thus take part in the timed switching cycles.

BRIEF DESCRIPTION OF THE DRAWINGS

Said method and an embodiment of an electric heating means according to the invention will be explained with the help of the drawings. In the drawings are.

DESCRIPTION OF THE PREFERRED EMBODIMENTS

Figure 1:
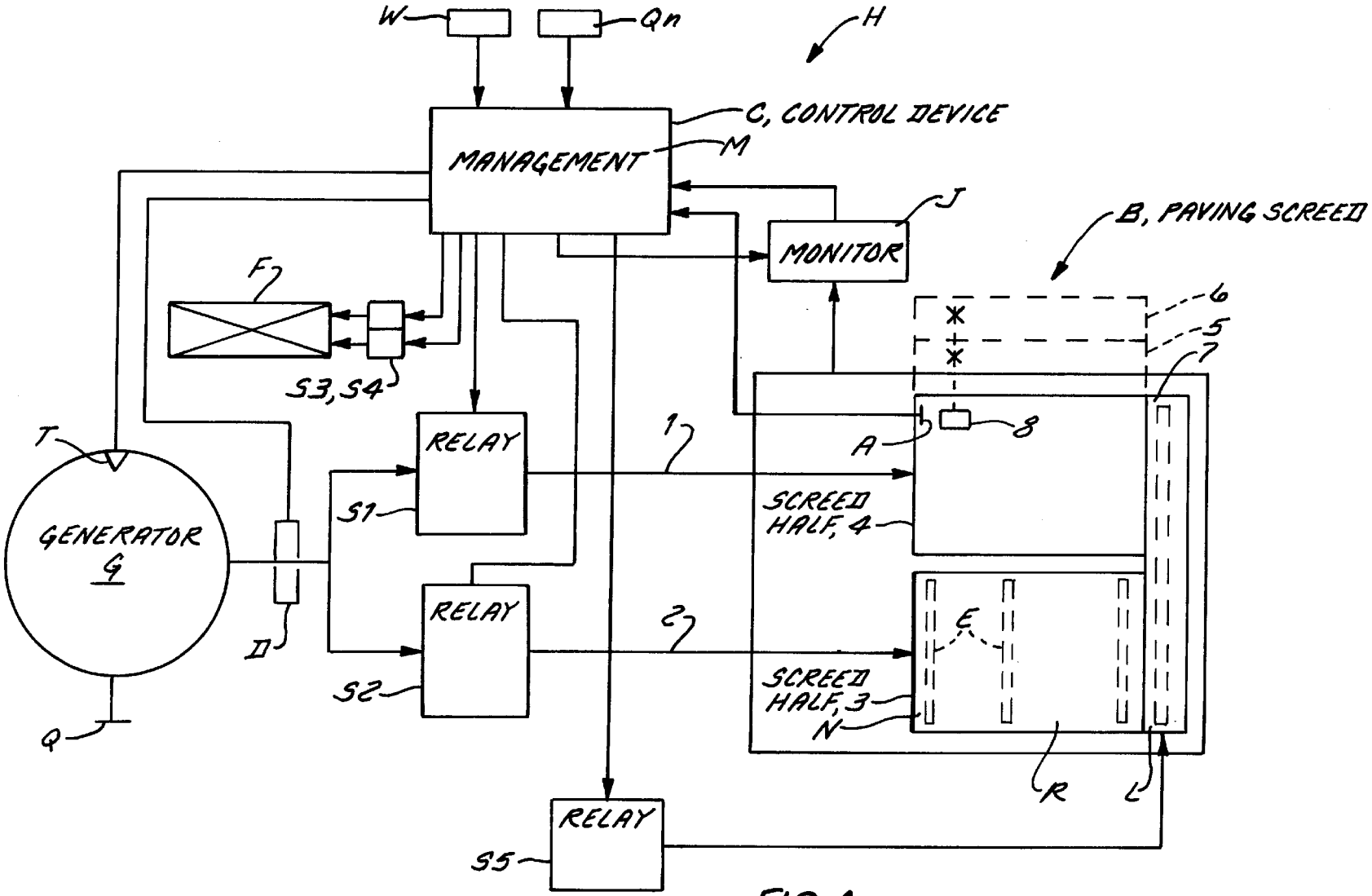
FIG. 1 is a block diagram of an embodiment of an electric heating means of a paving screed.
Figure 2:
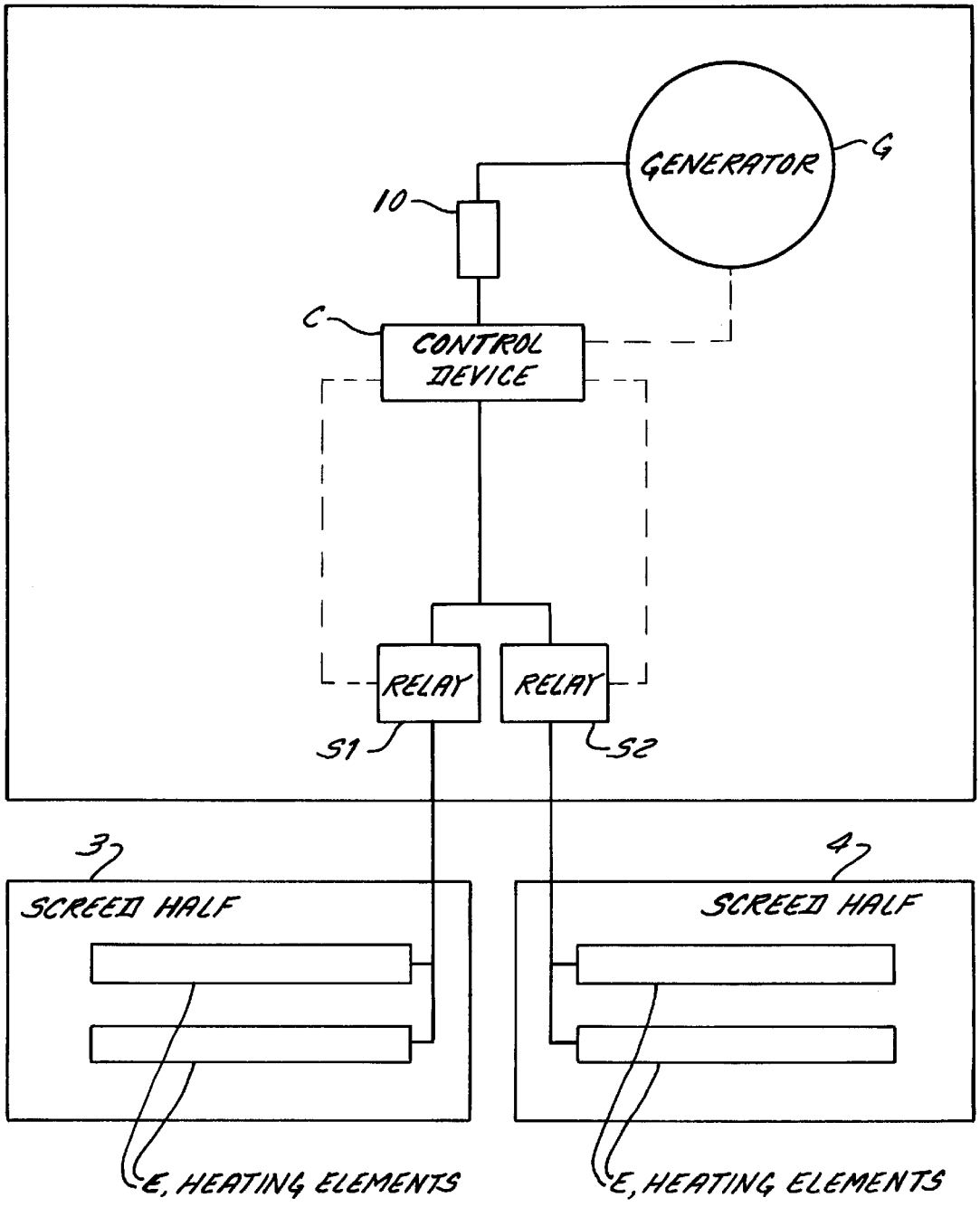
FIG. 2 is an exemplary block diagram of another embodiment of the electrical heater of a paving screed.

Important components of an electric heating means of a paving screed B which is towed by a not shown road finisher are schematically shown in the block diagrams in FIG. 1 and FIG. 2.

A primary drive source Q, in many cases a diesel engine, of the not shown road finisher is driving a rotary current generator G. Supply lines 1, 2 extend from generator G into both screed halves 3, 4 of the paving screed B or to heating elements E placed there. Said heating elements E serve to heat working components of the paving screed. Said working components may be e.g. tamper bars N, smoothing sole plates R and occasionally provided pressing bars L, all of which have to heated to about the temperature of the paving material so that the paving material does not tend to stick thereon.

Said heating means H is provided with a control device C in which a microprocessor equipped management section M is provided. By section M different operational parameters of the road finisher and/or said paving screed can be monitored and considered for controlling the heating means. A heating selector switch W is connected to control device C. Switch W can be switched between different positions "zero, automatic, manual". In position "zero" the heating means is switched off. In position "automatic" the heating means H is controlled automatically, particularly by a timing switchover in cycles to protect the rotary current generator G, to save energy, and in order to optimally regulate the maximum tolerable heating power. In position "manual" the heating means H is run permanently and under full heating power. The protective measures for the generator, however, even can be employed in the position "manual" as well.

In order to enable the microprocessor management section M to consider different operational parameters, information, measurements, and state confirmations of different connected devices are input. In the not shown coiling of the rotary current generator G temperature sensitive resistors are distributed which monitor different operational temperature threshold values and which output the respective measurement values, indicated by sensors T. At the exit side of the rotary current generator G a current monitoring system D is provided to control the power. Said system D also is connected to control device C. The current monitoring system D includes a current converter outputting the actual current value of one of the three phases of the rotary current generator to section M. Due to a symmetrical power distribution of the load it is possible to measure at one phase only and then to calculate the power of each of the other phases. The speed of the primary drive source Q is detected by an assembly Qn and is input to the control device C. Furthermore, an insulation monitoring assembly J is provided connected to the paving screed B and controlled by section M in order to output either an okay signal or a fault signal. The voltage for the generator is kept constantly at 230 V per phase to ground by means of a voltage regulator. The insulation monitoring assembly J measures the resistance between current conducting conductors and the neutral conductor to ground. For that reason said heating elements have to be grounded via a PE conductor. In case of an insulation fault said insulation monitoring system J is triggered and outputs a fault signal. Section M is then carrying out a fault search and allows only fault free circuits to operate.

Several relays or contactors S1–S5 are controlled by said microprocessor management section M. Relays or contactors S1, S2 are contained in the supply lines 1, 2 and are controlled depending on the operational situation. Expediently said relays or contactors are quattropolar contactors (having four poles). A further relay or contactor S5 is provided for the current supply of an additional heating means 7 optionally extending over the entire paving screed. Said additional heating 7 either is operated permanently or is switched off depending from the operational situation.

Further relays or contactors S3, S4 are provided for outlet F, expediently a shockproof or a CEE-outlet. Said CEE-outlets and their connections are protected by fuses. Due to the high temperatures in the paving screed B, the fusing have to be provided at the road finisher, and are expediently constituted by motor protective switches. Said protective switches protect conductors. Protected by fuses 10 also are all other supply lines. Due to a temperature compensation said protective switch exactly can be designed for the maximum allowable rated current of the paving screed. Said CEE-outlets can be used for frequency independent apparatuses, e.g. illumination devices. To the contrary, only 50 Hz apparatuses ought to be connected to the shockproof outlets. Both relays or contactors S2, S4 supply the CEE-outlets and the shockproof outlets, depending from the operational condition in an alternating fashion. Temperature sensors A located within said paving screed at the working components may be connected to the microprocessor management section M.

Outlets 8 at said paving screed B can be used to there plug-in respective heating elements of optionally mounted broadening parts 5, 6.

A release of a certain heating means depends on several conditions determined by section M. Said conditions for releasing the heating for operation may be for example: "heating selector switch "manual or automatic"; depending from the respective layout of the rotary current generator G (namely, heating to be released only in case of rated speed of the primary drive source, or heating to be released even in case of idling speed and of rated speeds of the primary drive source), a confirmation of the idling speed condition or a full load speed condition; insulation monitoring system J not responded with a fault signal; second temperature threshold on the rotary current generator not yet reached, etc."

In case the rotary current generator second temperature threshold is reached the heating means cannot be released at all. A release for operation only given if the rotary current generator has cooled down sufficiently and if the heating selector switch W has been switched to "zero" for confirmation purposes first.

In a switch casing at the road finisher (not shown) confirmation switcher for the insulation monitoring, the microprocessor management section M and the insulation monitoring system J are provided.

The paving screed is connected via several conducting lines and CEE-outlets, (e.g. five conductor lines) to the switch case.

As soon as after activating the heating selector switch W the above-mentioned conditions for releasing the heating are fulfilled, a heating process is started, controlled by said section M. After the beginning of the heating process the different heating combinations are controlled. The power demand per combination is calculated. Said combinations are controlled in an order defined by declining power demand. Each combination then is examined in view to validity. The combination having the highest valid power demand is released first.

Due to the linear characteristics of the temperature depending resistors provided in the coilings of the rotary current generator G several threshold values can be fixed. In case that the generator reaches a temperature of 20° C. above its ideal operational temperature (warning threshold) due to extreme conditions the regulation in section M, e.g. even in selected position "manual", switches over to a timing in cycles. This means that e.g. the heating elements E within the left half of the paving screed are switched off for a predetermined period of time, e.g. 30 seconds, and only the heating elements in the right half of the paving screed are kept switched on. After expiration of said time period the heating elements in the right half of the paving screed are switched off and the ones of the left half of the paving screed again are switched on. This procedure is repeated permanently in said cycles. As a result, the rotary current generator again can cool down, provided that there is no fault leading to a further heating. A further, so-called switch off temperature threshold is fixed just below the critical temperature of the generator coiling. As soon as this switch off threshold is reached, the heating means is switched off suddenly and totally. When controlling the timing in cycles only a few heating elements can be switched on and off, and/or are heating elements or only one heating element.

For the examination of the validity of the power release after actuating heating selector switch W the power demands of the different heating combinations are correlated to the characteristic curve of the generator temperature and then are released accordingly.

In case that the heating selector switch W is set to "automatic" (normal operation), said microprocessor management section M carries out the validity examination for the release, provided that the above-mentioned conditions for the heating release are fulfilled. After said examination said section is modulating the supplied power to a maximum such that the generator temperature permanently remains in the allowable range.

The paving screed B or the heating elements E, respectively, first need to be heated up until the working components N, R, L are heated to an extent at which the paving material does not stick to the screed and to the working components. After expiration of the time necessary for heating up the components sufficiently, paving can be started. The temperature of the paving material amounts to about 170° C. In order to maintain said already reached temperature of the working components essentially constant during a paving operation phase, e.g. the temperatures of the smoothing plates, the vibrators, the tamper and pressing bars, heat contributed by the paving material and the heat storage capacity of the paving screed are considered such that the entire available heating power will not be employed. Instead, the timed switching in cycles is carried out such that the right and left sides or halves of the screed alternatingly are switched for approximately 30 seconds. The rotary current generator G then only needs to supply about 50% of the screed's total power demand and is loaded less. Furthermore, a considerable amount of energy can be saved.

At an operational temperature of the generator below said warning threshold the alternating timing in cycles only is made if the paving screed is resting on the hot paving material, i.e. during the true paving working phase. This is done, as soon as the main driving switch of the finisher is switched into its position "paving travel forwards" and when the conveying device for the paving material is switched on and if the diesel serving as primary drive source is running at full speed.

Figure 3:
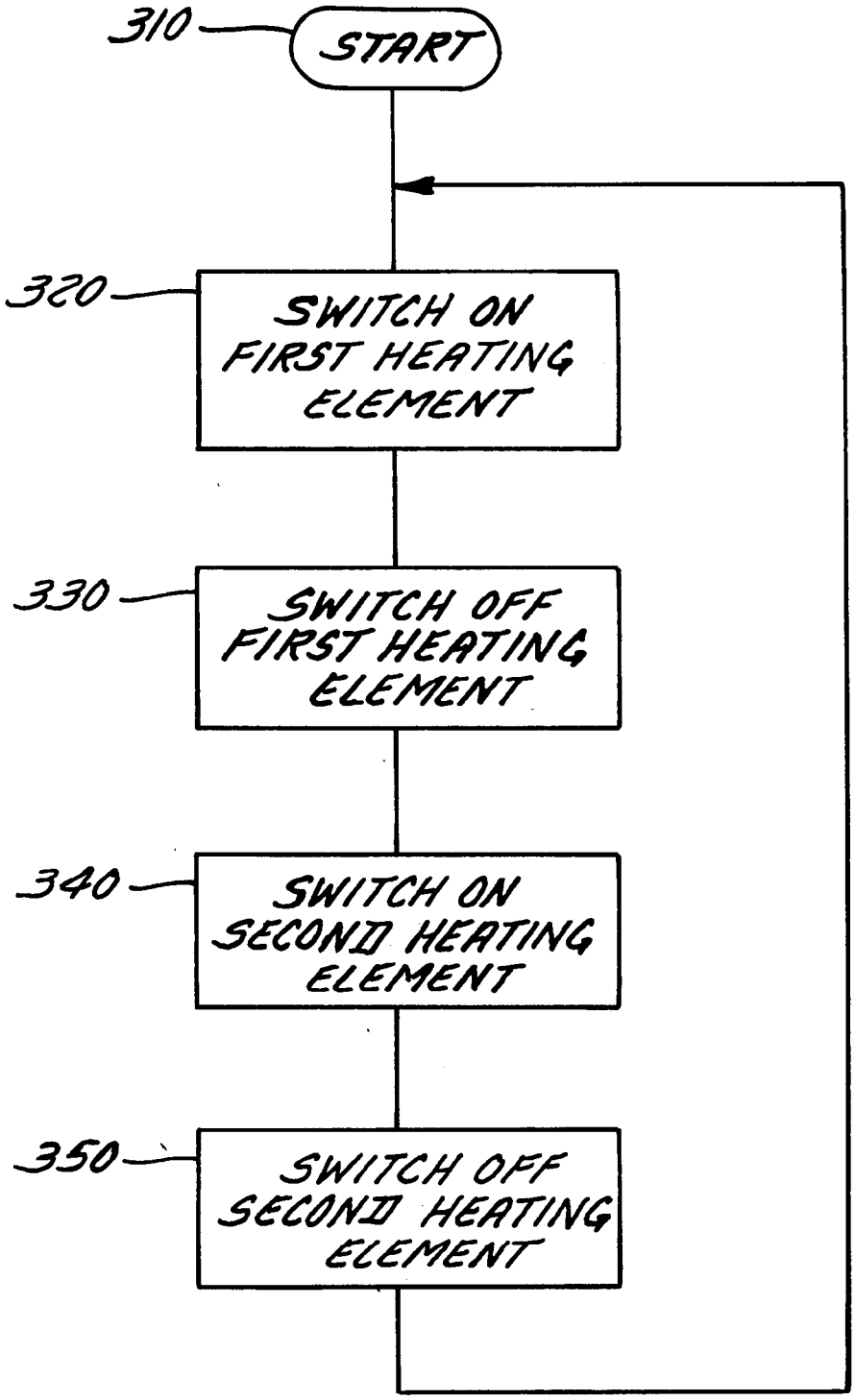
FIG. 3 is an exemplary flowchart outlining the operation of a control device according to one embodiment.

FIG. 3 is an exemplary flowchart outlining the operation of a control device C according to one embodiment. In step 310, the process begins. In step 320, the control device C switches on a first heating element E. In step 330, the control device C switches off the first heating element E. In step 340, the control device C switches on a second heating element E. In step 350, the control device C switches off the second heating element E. The control device C then returns to step 320. The heating elements can be switched on and off for specific periods of time. Also, the control device C can insert a delay between the steps. Furthermore, the control device C can also allow the steps to overlap. Additional features of alternative operations of the control device c are disclosed throughout the specification.

During a heat-up phase at selected position "automatic" the power is modulated such that it remains at an allowable maximum, e.g. proportionally to the temperature of the generator. In the selected position "manual" power is not modulated during the heating up phase. However, it may be controlled in a timed fashion in cycles as soon as a critical generator temperature has been reached. In the position "automatic", there are two possibilities to take influence which may be used alternatively or additively. The position "manual" has its particular justification, e.g. in case of low ambient temperature and/or cool paving material.

What is claimed is:

1. A method for heating the paving screed of a road finisher, said paving screed having a heating apparatus for heating paving material contacting screed components including at least two electric heating elements each powered by a rotary current generator of said finisher, comprising:

detecting an operation temperature of the rotary current generator during a paving operation of the road finisher; and powering the heating elements periodically in cycles by alternatingly switching them on and switching them off during the paving operation of the road finisher.

2. The method according to claim 1, wherein the heating elements are powered periodically in cycles based on an operation temperature of the rotary current generator.

3. The method according to claim 1, wherein the heating elements are powered periodically in cycles based on an operation temperature of the screed components in contact with the paving material.

4. The method according to claim 1, wherein the powering the heating elements periodically step is performed if a generator temperature threshold is exceeded by a predetermined temperature value above an ideal generator operation temperature.

5. The method according to claim 1, wherein the screed has left and right paving screed halves, each with heating elements, and wherein the elements of the left and right paving screed halves are switched on and off alternatingly in cycles.

6. The method according to claim 1, wherein a cycle period lasts between 15 seconds and 5 minutes.

7. The method according to claim 1, wherein a cycle period lasts approximately 30 seconds.

8. The method according to claim 1, wherein the powering the heating elements periodically step is started if a main drive switch of the road finisher is set to a paving travel forward condition, the conveying device for paving material is set to a conveying condition, and the primary drive source is adjusted to a speed condition.

9. The method according to claim 1, wherein the detecting step further comprises detecting the operation temperature with at least one temperature sensitive resistor inserted in a coiling of the generator, and wherein operational temperatures are detected by several temperature thresholds.

10. A method for heating the paving screed of a road finisher, said paving screed having a heating apparatus for heating screed components contacting paving material and including at least a first electric heating element and a second electric heating element each powered by a rotary current generator of said finisher, comprising:

switching on the first electric heating element at the beginning of a first cycle;

switching off the first electric heating element at the end of the first cycle;

switching on the second electric heating element at the beginning of a second cycle; and switching off the second electric heating element at the end of the second cycle, wherein a portion of the first cycle does not include a portion of the second cycle.

11. The method according to claim 10, wherein the heating elements are powered based on an operation temperature of the rotary current generator.

12. The method according to claim 10, wherein the heating elements are powered based on an operation temperature of the screed components in contact with the paving material.

13. The method according to claim 16, wherein the screed has left and right paving screed halves, each with heating elements, and wherein the elements of the left and right paving screed halves are switched on and off alternatingly in cycles.

14. The method according to claim 10, wherein the duration of the first cycle and the second cycle is determined based on the operation temperature of the screed components.

15. The method according to claim 10, wherein the first cycle does not overlap the second cycle.

16. An electrical heating apparatus of a paving screed road finisher, comprising:

working components of the paving screed;

at least two electric heating elements arranged within the paving screed in heat transfer connection to working components contacting paving material;

a control device coupled to the at least two electric heating elements; and a rotary current generator defining a power source coupled to the control device and the at least two electric heating elements, wherein the control device comprises a management section containing a program portion for cyclically powering the at least two heating elements by periodically and alternatingly switching on and switching off each heating element from the power of the rotary current generator at least during the paving operation phase of the road finisher.

17. The electrical heating apparatus according to claim 16, wherein the control device alternatingly switches on and switches off each heating element in a group with at least one other heating element.

18. The electrical heating apparatus according to claim 16, further comprising:

first sensors coupled to the rotary current generator and coupled to the control device; and second sensors coupled to the working components and coupled to the control device, wherein the control device comprises a management section equipped with a microprocessor that detects the operation temperature of the rotary current generator using the first sensors and of the working components using the second sensors.

19. The electrical heating apparatus according to claim 18, wherein the control device is further coupled to a heating selector switch and a speed detecting means of a primary drive source.

20. The electrical heating apparatus according to claim 18, wherein the first sensors comprise temperature sensitive resistors provided in a coiling of the rotary current generator, and wherein the control device monitors a warning temperature threshold and a switch off temperature threshold of the rotary current generator using the first sensors.

21. The electrical heating apparatus according to claim 18, further comprising a current monitoring system having a current converter for measuring the actual current provided in supply lines.

* * * * *